US011517115B2

(12) United States Patent
McCreary et al.

(10) Patent No.: US 11,517,115 B2
(45) Date of Patent: Dec. 6, 2022

(54) MODULAR FURNITURE WITH SHELF SUPPORT ASSEMBLY

(71) Applicants: McCreary Modern, Inc., Newton, NC (US); Helix Sleep, Inc., New York, NY (US)

(72) Inventors: Robert McCreary, Mooresville, NC (US); Bobby Gantt, Conover, NC (US); Seth Tulman, Brooklyn, NY (US); Jerry Lin, Oswego, OR (US)

(73) Assignees: MCCREARY MODERN, INC., Newton, NC (US); HELIX SLEEP, INC., New York, NY (US)

( * ) Notice: Subject to any disclaimer, the term of this patent is extended or adjusted under 35 U.S.C. 154(b) by 0 days.

(21) Appl. No.: 17/247,899

(22) Filed: Dec. 29, 2020

(65) Prior Publication Data

US 2021/0196049 A1 Jul. 1, 2021

Related U.S. Application Data

(60) Provisional application No. 62/955,081, filed on Dec. 30, 2019.

(51) Int. Cl.
*A47C 13/00* (2006.01)
*A47C 3/16* (2006.01)
(Continued)

(52) U.S. Cl.
CPC ..... *A47C 13/005* (2013.01); *A47C 3/16* (2013.01); *A47C 4/021* (2013.01); *A47C 17/04* (2013.01)

(58) Field of Classification Search
CPC ..... A47C 13/005; A47C 13/00; A47C 3/16; A47C 4/021; A47C 4/02
(Continued)

(56) References Cited

U.S. PATENT DOCUMENTS 3,183,036 A * 5/1965 Hill ..... A47C 4/028 297/440.22
3,788,700 A 1/1974 Wartes
(Continued)

FOREIGN PATENT DOCUMENTS

DE 202011000027 U 4/2011
GB 2524037 A 9/2015
JP S57-172555 A 10/1982

OTHER PUBLICATIONS

Triple Poang, *The astonishing cat resistant sofa*, Nov. 12, 2018, retrieved from Internet on Mar. 26, 2021, https://www.ikeahackers.net/2018/11/ikea-poang-3-seat-sofa.html.
(Continued)

*Primary Examiner* — Mark R Wendell
(74) *Attorney, Agent, or Firm* — Alston & Bird LLP

(57) ABSTRACT

A modular seat and method of assembling the same are provided. The modular seat includes a first seating component having one or more seating component attachment apertures. The modular seat also includes a first arm component having a first arm component shelf support configured to be received by one of the seating component attachment apertures. The modular seat may include one or more other components, such as attachment members, additional seating components, back support components, and/or additional arm components. A corresponding method of assembling a modular seat is also provided.

20 Claims, 16 Drawing Sheets

(51) Int. Cl.
*A47C 4/02* (2006.01)
*A47C 17/04* (2006.01)

(58) Field of Classification Search
USPC ..... 297/440.14
See application file for complete search history.

(56) References Cited

U.S. PATENT DOCUMENTS

| | | | | |
|---|---|---|---|---|
| 3,973,800 | A | 8/1976 | Kogan | |
| 4,077,666 | A * | 3/1978 | Heumann | A47C 13/005 297/248 |
| 5,738,414 | A | 4/1998 | Weiland et al. | |
| 5,890,767 | A * | 4/1999 | Chang | A47C 4/02 297/440.14 |
| 6,824,220 | B1 | 11/2004 | Davison | |
| 7,240,967 | B2 | 7/2007 | Wade | |
| 7,448,689 | B2 | 11/2008 | Carter et al. | |
| 7,806,474 | B2 | 10/2010 | Wahl et al. | |
| 8,646,843 | B2 * | 2/2014 | Koch | A47C 17/02 297/440.14 |
| 8,783,778 | B2 * | 7/2014 | Nelson | A47C 13/005 403/395 |
| 9,028,003 | B2 * | 5/2015 | Yeh | A47C 7/24 297/440.14 |
| 9,532,651 | B2 | 1/2017 | Chung | |
| 10,159,355 | B2 | 12/2018 | Policicchio | |
| 10,182,659 | B2 | 1/2019 | Kuhl et al. | |
| 10,327,557 | B2 | 6/2019 | Gary et al. | |
| 10,506,883 | B2 * | 12/2019 | Hirschhaut | A47C 7/407 |
| 10,905,245 | B2 * | 2/2021 | Bangalore | A47C 4/02 |
| 11,147,385 | B1 | 10/2021 | Kuhl et al. | |
| 2003/0218365 | A1 | 11/2003 | Kawiaka | |
| 2005/0067876 | A1 * | 3/2005 | Dortch | A47C 4/02 297/440.1 |
| 2005/0179303 | A1 * | 8/2005 | Owens | A47C 7/42 297/440.1 |
| 2016/0262542 | A1 | 9/2016 | Chung | |
| 2017/0071354 | A1 | 3/2017 | Mezzera | |
| 2018/0271294 | A1 | 9/2018 | Chiriac | |

OTHER PUBLICATIONS

International Search Report and Written Opinion of PCT/US2020/067353 (ISA/EP) dated Apr. 30, 2021 (11 pages).

* cited by examiner

MODULAR FURNITURE WITH SHELF SUPPORT ASSEMBLY

CROSS REFERENCE TO RELATED APPLICATION

This application claims the benefit of U.S. Provisional Application No. 62/955,081, filed Dec. 30, 2019, which is hereby incorporated by reference in its entirety.

FIELD

An example embodiment relates generally to modular furniture and, more particularly, to attachment configurations of modular furniture.

BACKGROUND

Large, bulky furniture can often be difficult to move, especially through tight spaces, such as an apartment. Therefore, there is a need for modular furniture that can be shipped compactly and then assembled within the space to be used. Additionally, there is a need for easy assembly that does not require extensive assembly knowledge and/or expensive tools. Applicant has identified a number of deficiencies and problems associated with existing modular furniture. Through applied effort, ingenuity, and innovation, many of these identified problems have been solved by the apparatus and method of the present disclosure.

BRIEF SUMMARY

The following presents a simplified summary in order to provide a basic understanding of some aspects of the present disclosure. This summary is not an extensive overview and is intended to neither identify key or critical elements nor delineate the scope of such elements. Its purpose is to present some concepts of the described features in a simplified form as a prelude to the more detailed description that is presented later.

In an example embodiment, a modular seat is provided. The modular seat includes a first seating component having one or more seating component attachment apertures. The modular seat also includes a first arm component having a first arm component shelf support configured to be received by one of the seating component attachment apertures.

In some embodiments, the modular seat also includes an attachment member. In such an embodiment, the attachment member is configured to be received by one of the seating component attachment apertures and when the attachment member is received by one of the seating component attachment apertures, a portion of the attachment member extends beyond the seating component attachment aperture. In some embodiments, the modular seat also includes a second seating component having one or more seating component attachment apertures. In such an embodiment, the portion of the attachment member extending beyond the seating component attachment aperture of the first seating component is configured to be received by one of the seating component attachment apertures of the second seating component.

In some embodiments, the seating component further includes a seating component shelf support configured to be received by a back support attachment aperture. In some embodiments, the modular seat also includes a back support component having a back support attachment aperture to receive the seating component shelf support. In some embodiments, the seating component is attached to the arm component via a base attachment mechanism and the back support component also includes an adjacent back support attachment mechanism.

In some embodiments, at least one leg is attached to the attachment member. In some embodiments, the one or more seating component attachment apertures are disposed along the bottom of the seating component. In some embodiments, the modular seat also includes a second arm component that includes a second arm component shelf support. In such an embodiment, the second arm component shelf support is configured to be received by one of the attachment apertures that is not attached to the first arm component shelf support. In some embodiments, the modular seat also includes one or more seat extensions. In such an embodiment, the seat extension includes an additional seating component and an additional back support. In such an embodiment, the additional seating component is attached to one of the other seating components via an attachment member.

In another example embodiment, a method of assembling a modular seat is provided. The method includes providing a first seating component having one or more seating component attachment apertures. The method also includes attaching a first arm component to the first seating component by attaching a first arm component shelf support to one of the seating component attachment apertures.

In some embodiments, the method also includes attaching an attachment member to one of the seating component attachment apertures not attached to the arm component shelf support such that a portion of the attachment member extends beyond the seating component attachment aperture. In some embodiments, the method also includes attaching a second seating component having one or more seating component attachment apertures to the attachment member.

In some embodiments, the method also includes attaching the first seating component to a back support component by attaching a seating component shelf support to a back support component attachment aperture. In some embodiments, the first seating component is attached to the first arm component via a base attachment mechanism and the back support component also includes a back support connection mechanism. In some embodiments, the method also includes attaching at least one leg to the attachment member.

In some embodiments, the one or more seating component attachment apertures are disposed along the bottom of the seating component. In some embodiments, the base attachment mechanism includes a t-handle screw. In some embodiments, the method also includes attaching a second arm component that includes a second arm component shelf support. In such an embodiment, the second arm component shelf support is configured to be received by one of the attachment apertures that is not attached to the first arm component shelf support. In some embodiments, the method also includes attaching one or more seat extensions. In such an embodiment, the seat extension includes an additional seating component and an additional back support, and the additional seating component is attached to one of the other seating components via an attachment member.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Figure 1A:
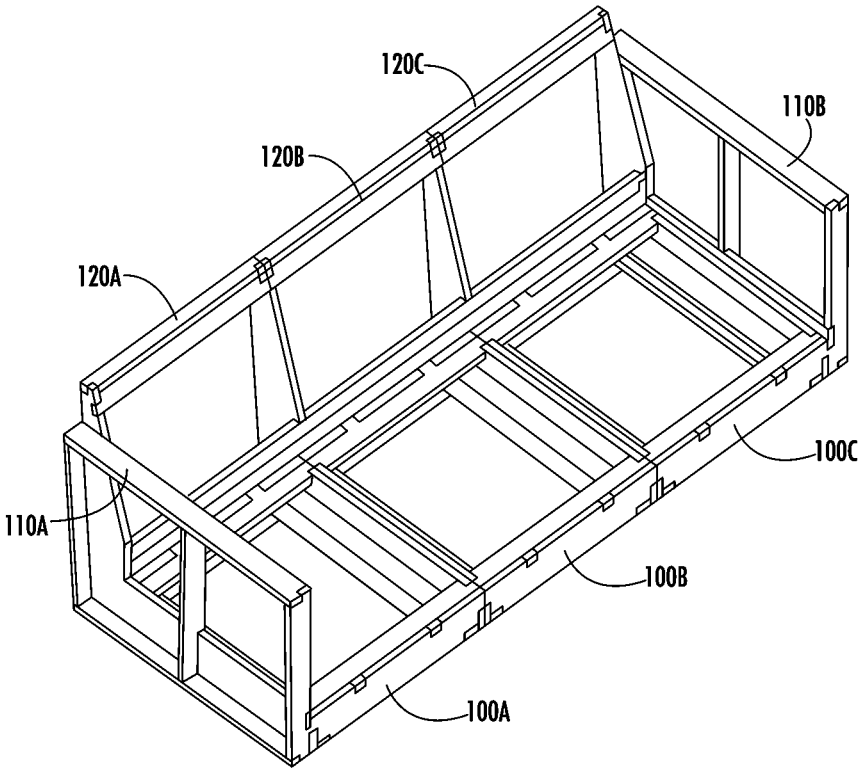
Figure 1B:
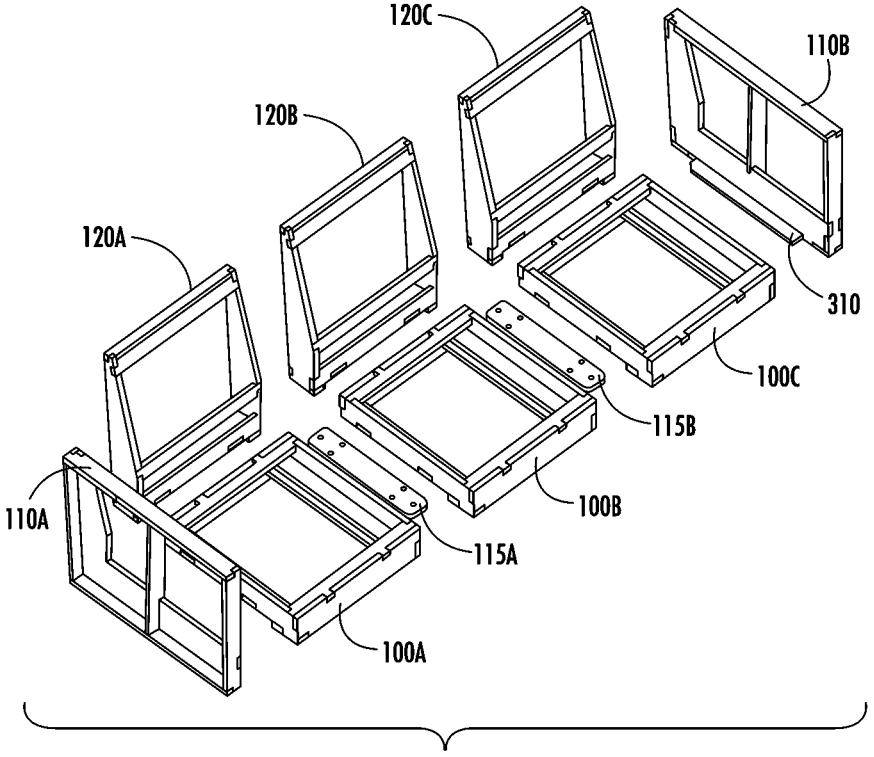
Figure 2:
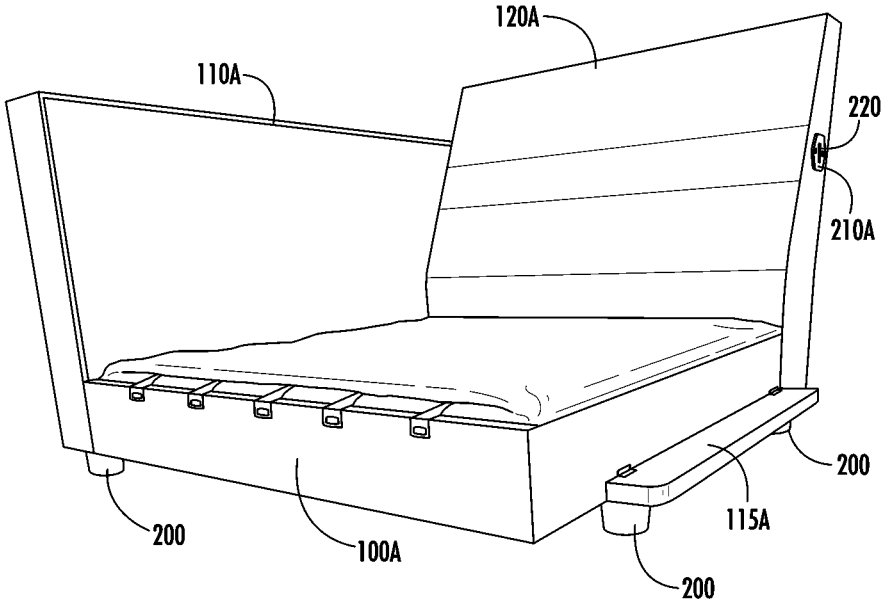
Figure 3A:
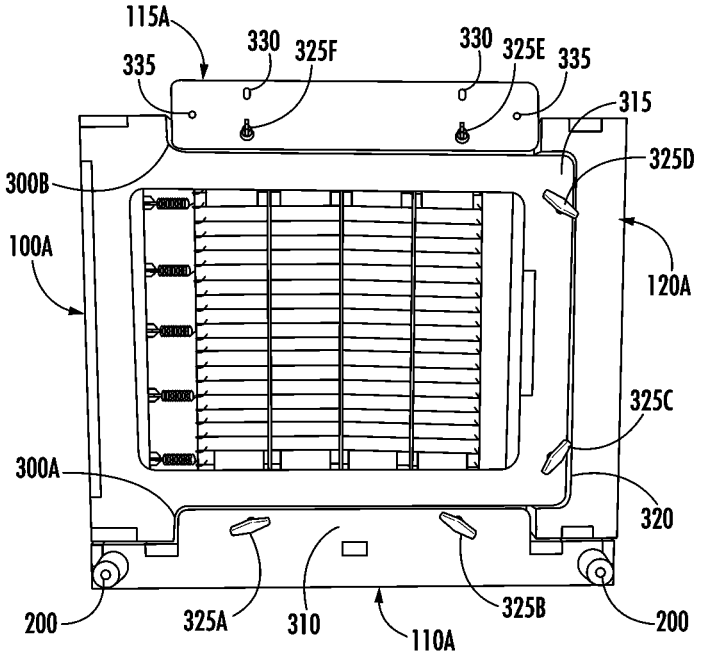
Figure 3B:
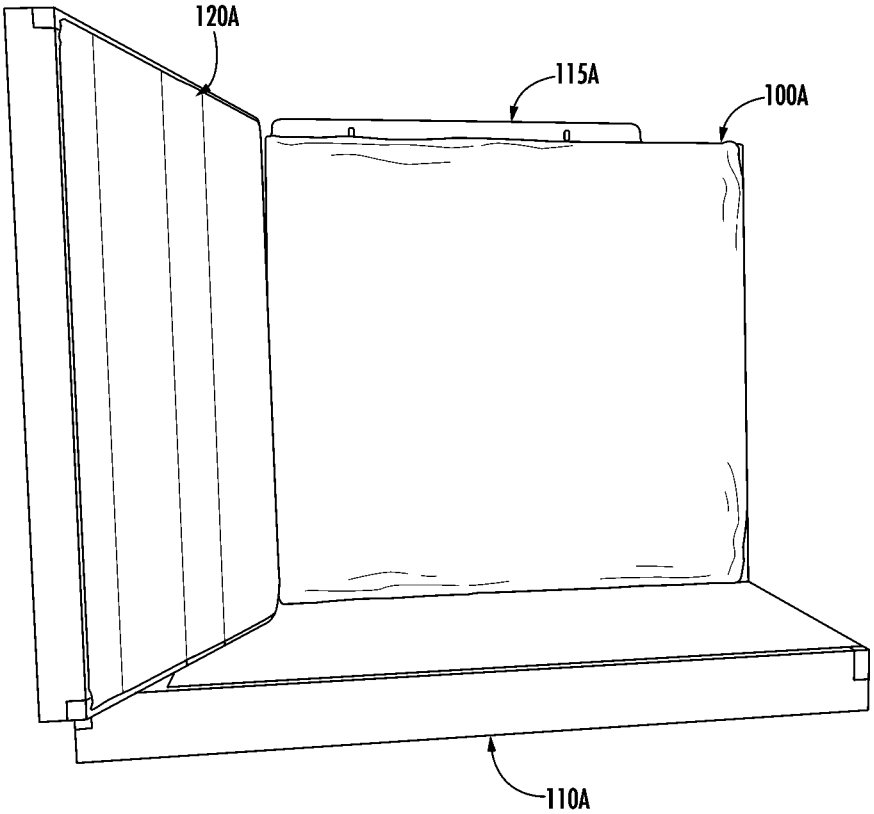
Figure 4:
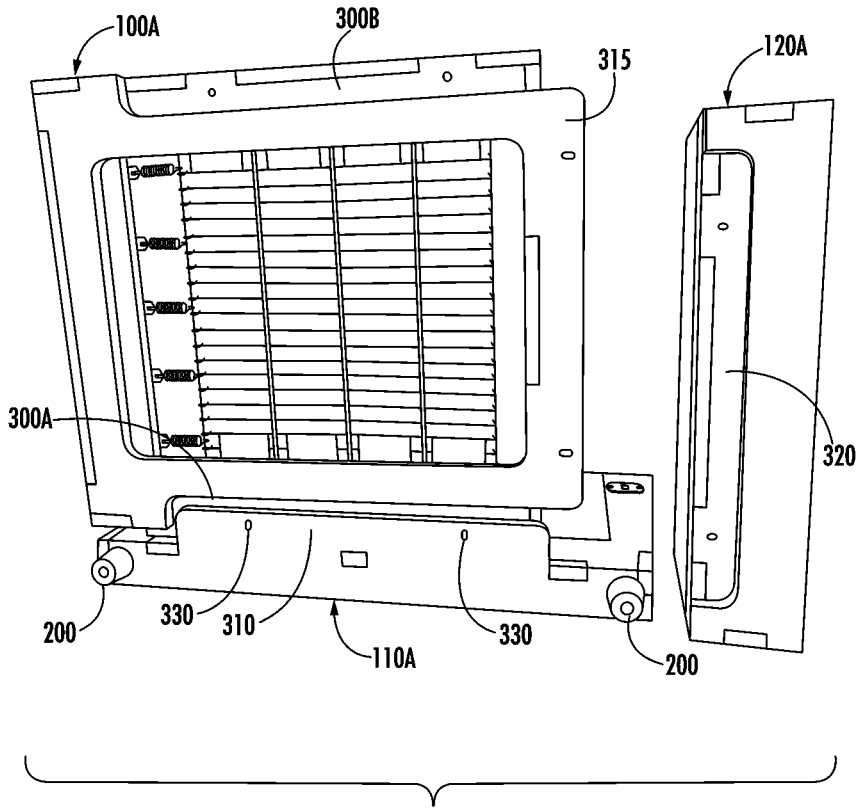
Figure 5A:
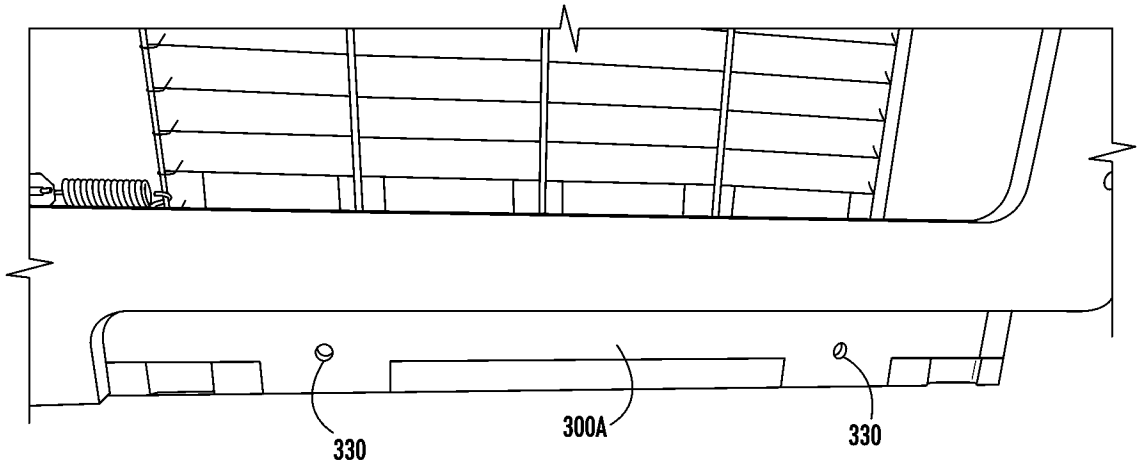
Figure 5B:
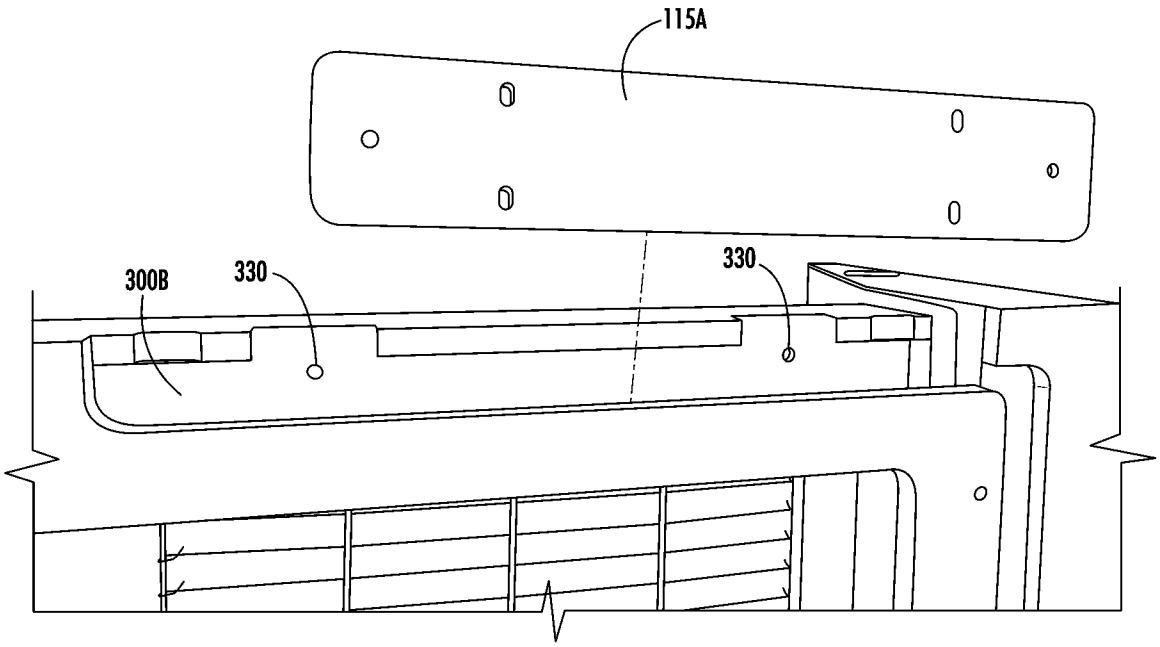
Figure 5C:
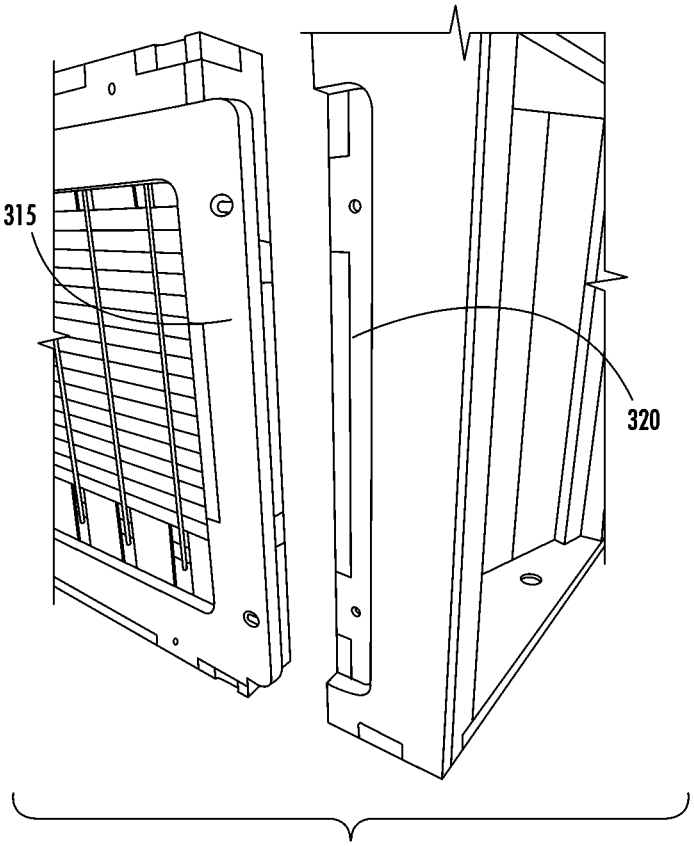
Figure 6:
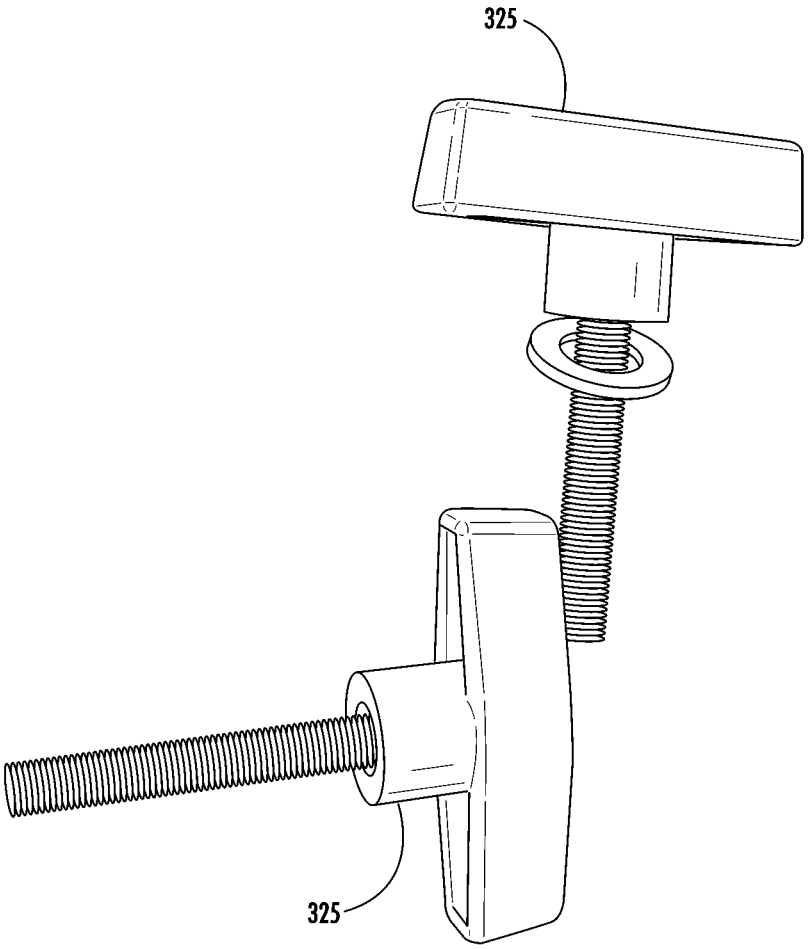
Figure 7:
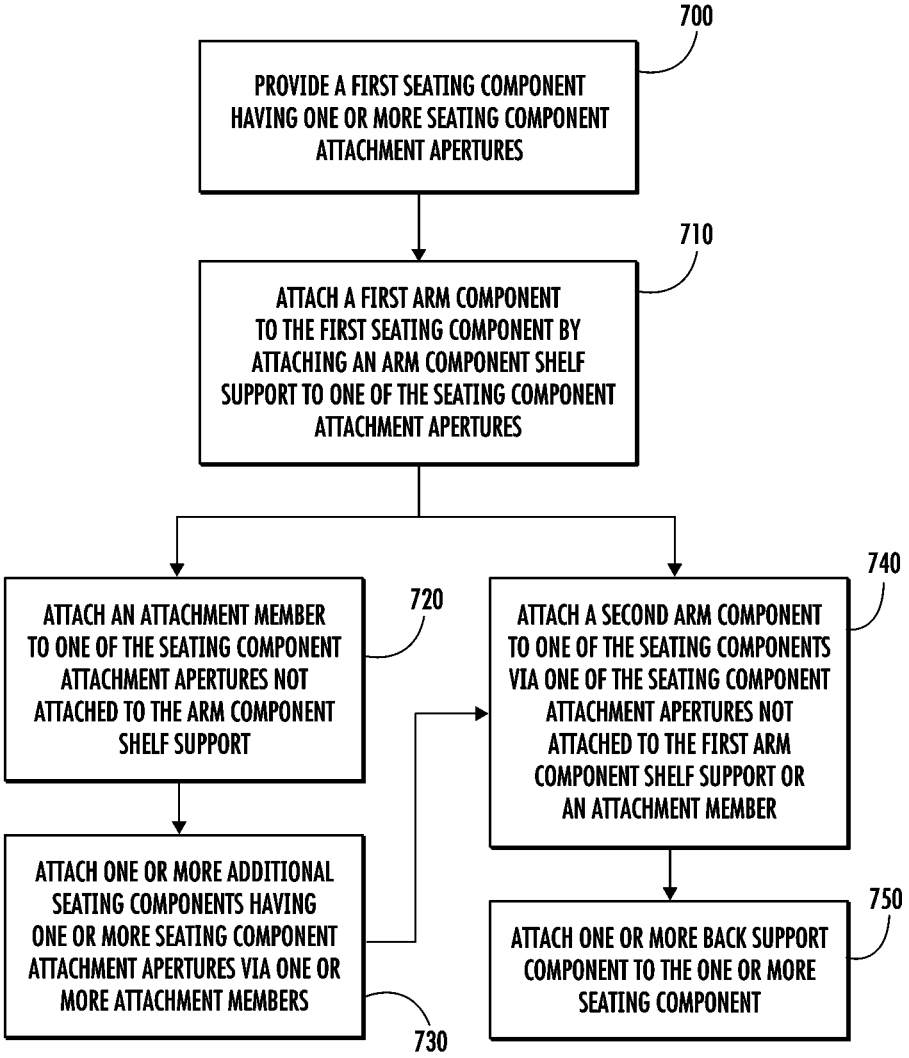
Figure 8A:
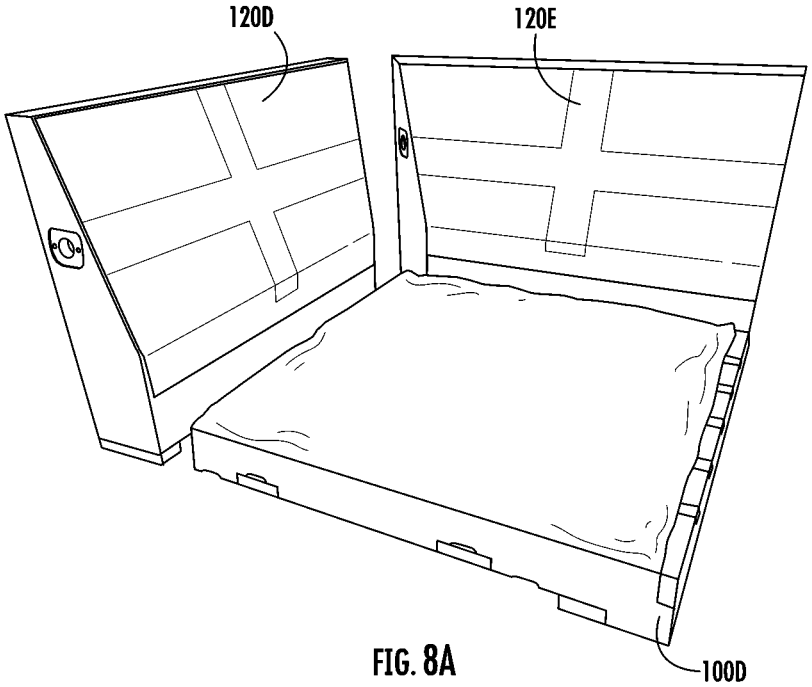
Figure 8B:
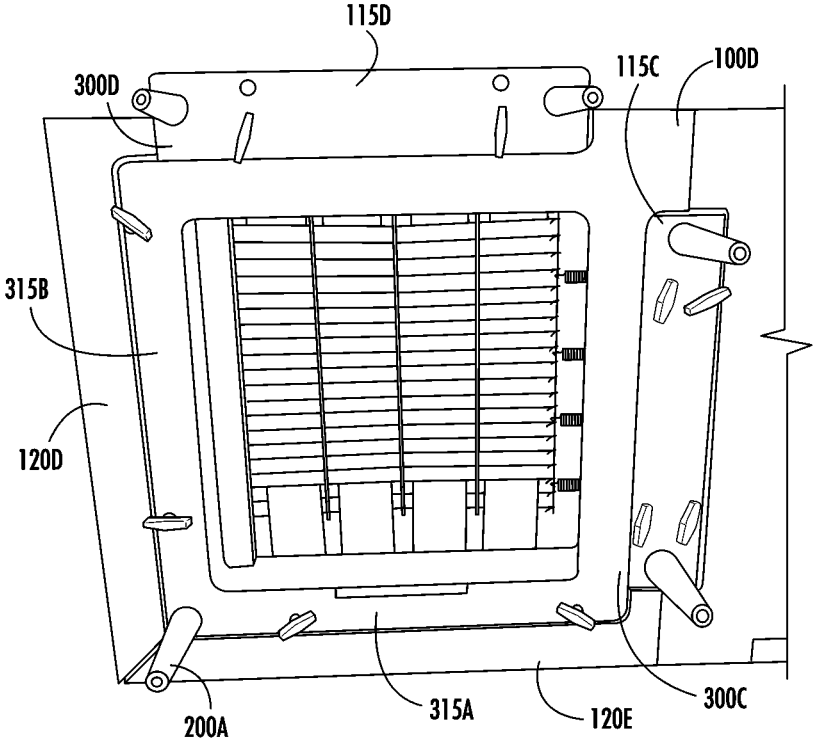
Figure 9B:
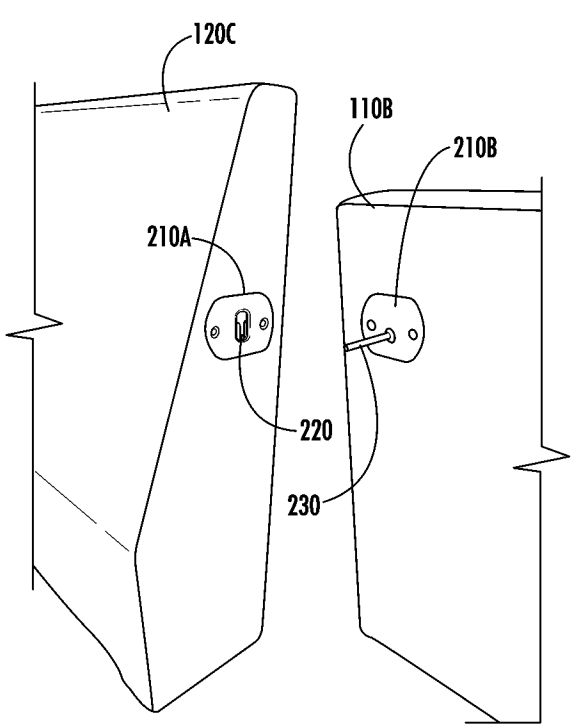
Figure 9A:
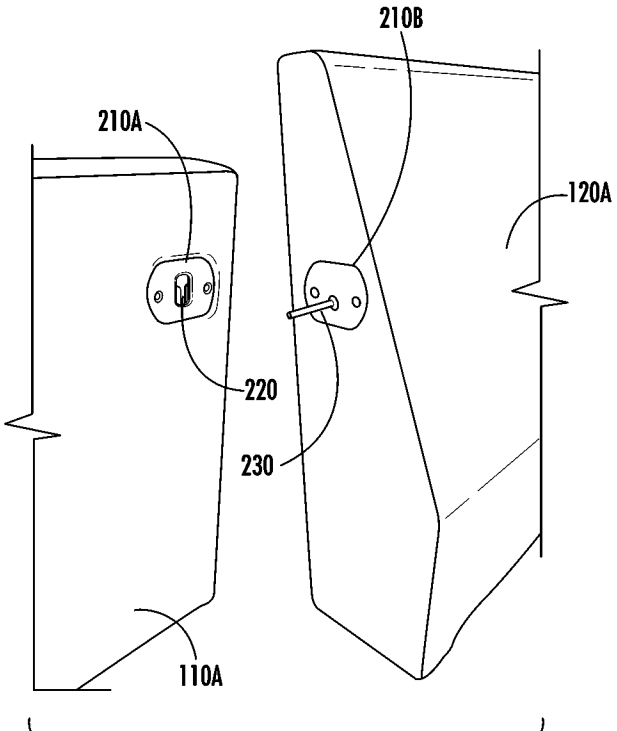
Figure 9D:
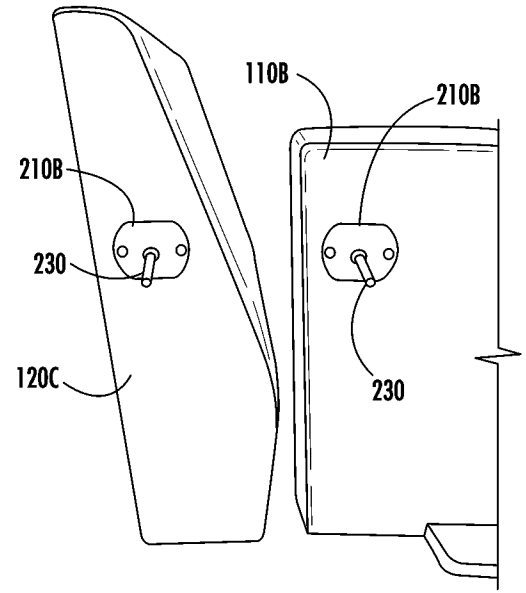
Figure 9C:
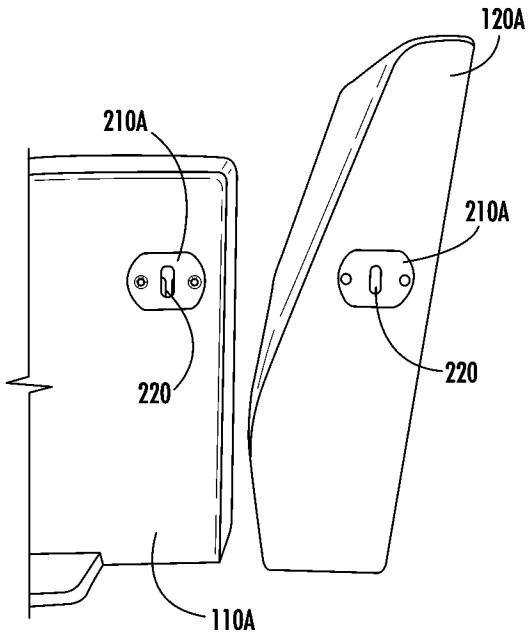
Figure 10:
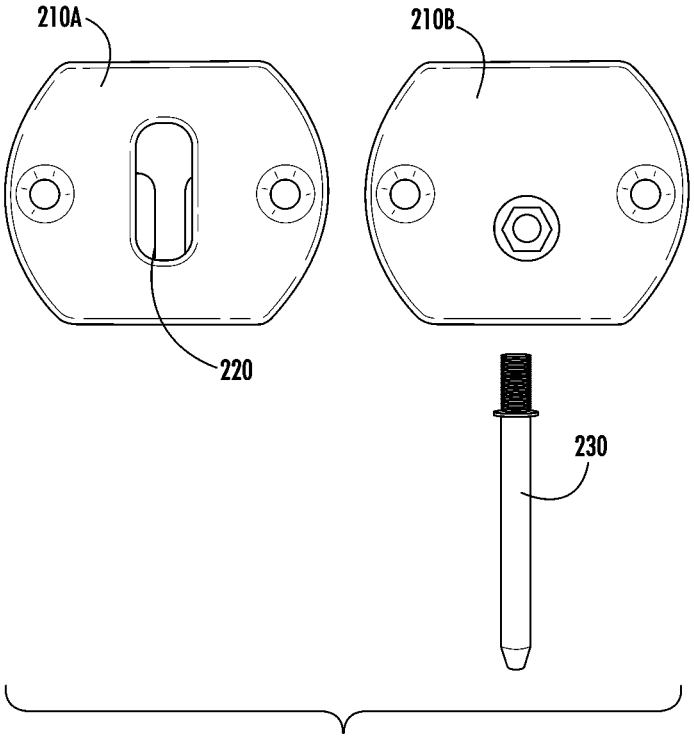

Having thus described certain example embodiments of the present disclosure in general terms, reference will hereinafter be made to the accompanying drawings, which are not necessarily drawn to scale, and wherein:

FIG. 1A illustrates a structural view of a modular sofa in accordance with certain example embodiments;

FIG. 1B illustrates an exploded view of the modular sofa shown in FIG. 1A in accordance with certain example embodiments;

FIG. 2 illustrates a partially assembled modular seat in accordance with certain example embodiments;

FIG. 3A illustrates a bottom view of the partially assembled modular seat shown in FIG. 2 in accordance with certain example embodiments;

FIG. 3B illustrates a top view of the partially assembled modular seat shown in FIG. 2 in accordance with certain example embodiments;

FIG. 4 illustrates a disassembled version of the modular seat shown in FIGS. 2-3B in accordance with certain example embodiments;

FIG. 5A illustrates an attachment aperture located on the seat component in accordance with certain example embodiments;

FIG. 5B illustrates a second attachment aperture located on the seat component opposite the attachment aperture shown in FIG. 5A in accordance with certain example embodiments;

FIG. 5C illustrates a shelf support assembly of the seat component configured to be received by the attachment aperture of the back support component in accordance with certain example embodiments;

FIG. 6 illustrates an example attachment mechanism for the various components discussed herein;

FIG. 7 illustrates a method of assembling a modular seat in accordance with certain example embodiments;

FIG. 8A illustrates a corner seating component configured to form a sectional sofa in accordance with certain example embodiments;

FIG. 8B illustrates the bottom of the corner seating component shown in FIG. 8A in accordance with certain example embodiments;

FIG. 9A illustrates the back support attachment mechanism interaction between an arm component and a back support component in accordance with certain example embodiments;

FIG. 9B illustrates another back support attachment mechanism interaction between an arm component and a back support component in accordance with certain example embodiments;

FIG. 9C illustrates another view of the back support component and arm component shown in FIG. 9A in accordance with certain example embodiments;

FIG. 9D illustrates another view of the back support component and arm component shown in FIG. 9A in accordance with certain example embodiments; and FIG. 10 illustrates both a back support attachment mechanism in accordance with certain example embodiments.

DETAILED DESCRIPTION

Some embodiments will now be described more fully hereinafter with reference to the accompanying drawings, in which some, but not all, embodiments are shown. Indeed, various embodiments may be embodied in many different forms and should not be construed as limited to the embodiments set forth herein; rather, these embodiments are provided so that this disclosure will satisfy applicable legal requirements.

The components illustrated in the figures represent components that may or may not be present in various embodiments of the invention described herein such that embodiments may include fewer or more components than those shown in the figures while not departing from the scope of the invention. Some components may be omitted from one or more figures or shown in dashed line for visibility of the underlying components. Various references to the "top" or "bottom" may refer to an instance in which the modular seat is in use (e.g., the bottom may not be visible). While various embodiments discussed herein relate to modular seating, various embodiments of the present disclosure may also be used for other furniture, such as ottomans or the like.

Modular Seat with Shelf Support Assembly

Various embodiments discussed herein allow for a modular seat that can be easily assembled on-site with little to no difference in stability to a standard non-modular seat. The present disclosure uses redesigned components to provide a modular seat without the need for complex fasteners. The shelf support assembly discussed herein allows for components to be attached to one another using simple attachment mechanisms, such as a t-handle screw. Therefore, no additional tools may be required to assemble the modular seat. Additionally, the shelf support assembly provides additional stability to the modular seat that is not present in typical fastening designs.

FIGS. 1A and 1B illustrate structural views of a modular sofa in accordance with the modular seat discussed herein. In various embodiments, the components herein may be used to make pieces of furniture of various sizes. In some embodiments, the modular seat may include one or more seating components 100A-C, one or more arm components 110A-B, one or more back support components 120A-C, and/or one or more attachment members 115A-B. In various embodiments, the number of components used may be based on the size of the seat being assembled. For example, in the sofa shown in FIGS. 1A and 1B, the modular seat includes three seating components 100A-C, two arm components 110A-B, two attachments members 115A-B, and three back support components 120A-C. As discussed herein, the seating component 100 may be configured with attachment apertures (shown, for example, as reference numbers 300A, 300B in FIGS. 3A, 4, 5A, 5B, and 5C) that may receive a shelf support of an arm component 110 or an attachment member 115. As shown in FIG. 1B, the attachment member 115A may attach one seating component 100A to another seating component 100B in order to expand the seating area of the modular seat. Additionally, the arm component 110A may be attached to the seating components 100A and/or 100C at one or both ends of the combined seating area, such that the arm component(s) 110A-B provide one or more armrests for the modular seat. In some embodiments, one or more of the arm components 110A-B may not be present in a modular seat, such as when a user desires a chair with no arms. Various modular seats of certain embodiments discussed herein may have internal components similar to current furniture designs (e.g., springs and the like). Additionally, the various components discussed herein may include additional cushioning and/or covers based on the design of the modular seat.

FIG. 2 illustrates a partially assembled modular seat in accordance with various embodiments of the present disclosure. The portion of the modular seat shown in FIG. 2 may be expanded to include two or more seating components 100. As shown, the seat component 100A may have an arm component 110A attached on one side, with an attachment member 115A attached on the other end of the seat component 100A. In some embodiments, the attachment member 115A may be configured to attach to a seat component 100A and then extend beyond said seat component 100A, such that the attachment member 115A may be attached to another seat component 100B, as discussed with regard to FIG. 1. In some embodiments, one or more components discussed herein may be integral to one another. For example, in some embodiments, one or more seating components (e.g., 120A-C) may have an integral attachment member in place of an attachment aperture.

In some embodiments, the back support component 120A may include a back support attachment mechanism 210A configured to operably couple two back support components (e.g., coupling back support component 120A to back support component 120B as shown in FIGS. 1A-B) in an instance in which multiple back support components 120A-C are used in a modular seat. In some embodiments, the back support component 120A may be configured with a portion of the back support attachment mechanism 210A on each side of the back support component 120A. For example, as shown, the back support attachment mechanism 210A may include a receiving hole 220 configured to receive a pin or the like of another back support attachment mechanism 210. In some embodiments, the back support components 120A-C may have a female connector 210A (e.g., a receiving hole 220) on one side and then a male connector 210B (e.g., a pin 230) on the other such that the receiving hole 220 of a first back support component 120A may receive a pin 230 from an adjacent second back support component 120B on one side and the pin 230 from the third back support component 120C can engage the receiving hole 220 of the adjacent second back support component 120B. In some instances, the arm components 110A, 110B may include a pin 230 or receiving hole 220 configured to engage with an adjacent back support component 120A-C, as discussed in more detail in reference to FIGS. 9A-D below.

In some embodiments, the modular seat may have a plurality of legs 200 configured at various positions on the modular seat, for example, at various positions on the bottom of the modular seat. In some embodiments, the attachment member 115 may be configured to receive one or more legs 200. For example, the leg may screw into a hole in the attachment member 115. Additionally, the arm component 110 may be configured to receive one or more legs 200. In various embodiments, one or more legs 200 may be attached to various other components (e.g., the leg 200A may be attached to the seating component 100D shown in FIG. 8B).

FIGS. 3A and 3B illustrate a bottom view and a top view, respectively, of the partially assembled modular seat shown in FIG. 2 in accordance with certain example embodiments. As shown, the attachment of the components may be achieved on the bottom side of the modular seat, such that the top of the modular seat shows no visible attachments means. In some embodiments, the seating component 100 may include one or more seating component attachment apertures 300A, 300B. In some embodiments, the seating component 100 may also include a seating component shelf support 315 configured to be received by a back support component attachment aperture 320.

In some embodiments, the arm component 110 may include an arm component shelf support 310 configured to be received by a seating component attachment aperture 300A. In various embodiments, the arm component shelf support 310 may be attached to the seating component 100 via one or more base attachment mechanisms 325 (e.g., 325A, 325B). As shown in FIG. 6, the base attachment mechanism 325 may be a screw, such as a t-handle screw. For example, a t-handle screw may be used to allow for a user to easily assemble the modular seat without any additional tools. Various other attachment mechanisms may be contemplated, such as the screws (e.g., attachment mechanisms 325E, 325F) shown attaching the attachment member 115 to the seat component 100. In various embodiments, the arm component shelf support 310 may be shaped such that the arm component shelf support 310 fits flush into the attachment aperture 300A. In various embodiments, the depth of the seating component attachment apertures 300A, 300B may correspond to the height of the arm component shelf support 310 and/or the attachment member 115, such that the bottom of modular seat is relatively flat in an instance the arm component 110 and/or attachment member 115 are attached to the seat component 100.

In some embodiments, the attachment member 115 may include a plurality of component attachment points 330 (e.g., holes to receive screws). As shown, the attachment member 115 may fit flush with the seating component attachment aperture 300B and extend beyond the edge of the seating component 100, such that an additional seating component 100 may be attached to the attachment member 115 (e.g., attached via component attachment points 330). In some embodiments, the attachment member 115 may include one or more leg attachment points 335 configured to receive a leg 200 (e.g., each leg 200 may have a screw that engages with the leg attachment point 335).

In some embodiments, the back support component 120 may include a back support component attachment aperture 320 configured to receive a seating component shelf support 315. As shown, the seating component shelf support 315 may be attached to the back support component 120 via one or more base attachment mechanisms (e.g., attachment mechanisms 325C and 325D). In various embodiments, the depth of the back support component attachment aperture 320 may correspond to the height of the seating component shelf support 315, such that the bottom of the modular seat is relatively flat when the seating component 100 is attached to the back support component 120. As shown, the back support component 120 may be shaped to fit flush with the arm component 110 to create an approximately right angle. In some embodiments, the back support component 120 may have a back support shelf support, similar to the shelf support of the arm component 110, that is configured to be received by an additional seating component attachment aperture.

FIGS. 4-5C illustrate various views of the partially assembled modular seat discussed with regard to FIGS. 2-3B disassembled in accordance with certain example embodiments. For example, FIG. 4 illustrates each of the seating component 100, the arm component 110, and the back support component 120 detached in their relative placement to one another. FIG. 5A illustrates a close-up view of seating component attachment aperture 300A without any other components. As shown, the seating component attachment aperture 300A may include one or more attachment points 330 configured to receive one or more attachment mechanisms 325 discussed herein. In various embodiments, the depth of the attachment apertures (e.g., 300A) may be based on the amount of recess of the legs under the seating component 100. For example, the seating component attachment aperture 300A may be 13/16 inches deep. Additionally, the thickness of the attachment member may be based off the material thickness of the rest of the modular seat frame. FIG. 5B illustrates the seating component attachment aperture 300B detached from but near the attachment member 115. FIG. 5C illustrates the seating component shelf support 315 detached from but near the back support component aperture 320.

FIG. 8A illustrates a corner seating component 100D configured for use in a sectional sofa. In various embodiments, the corner seating component 100D may be configured to be attached to a plurality of back support components 120D, 120E. For example, as shown in FIG. 8B, the corner seating component 100D may include a plurality of seating component shelf supports 315A, 315B configured to engage the back support attachment aperture of each back support component 120D, 120E. Additionally, the corner seating component 100D may also include a plurality of seating component attachment apertures 300C, 300D configured along perpendicular sides of the corner seating component 100D to each receive an attachment member 115C, 115D. In some embodiments, the corner seating component 100D may have one or more legs 200A attached to the bottom of the seating component in addition to the one or more legs 200 attached to the attachment members.

FIG. 9A illustrates the back support attachment mechanism 210A, 210B of a first arm component 110A and a first back support component 120A. In an example embodiment, the first arm component 110A may have the opposite connector to the side of the back support component 120A that is being attached. For example, as shown in FIG. 9A, the first arm component 110A may have a female connector 210A configured with a receiving hole 220 in an instance in which the first back support component 120A has a male connector 210B configured with a pin 230, such that the pin 230 engages the receiving hole 220 to provide additional stability and/or support for the arm component and the back support component. As shown in FIG. 9C, the first back support component 120A may have a female connector 210A on the opposite side, such that the back support component may also engage with another adjacent arm component and/or another back support component.

FIG. 9B illustrates the second arm component 110B and an adjacent back support component (e.g., the third back support component 120C shown in FIGS. 1A-1B). As shown, the second arm component 110B may have the opposite connector type from the first arm component 110A. For example, as shown, the second arm component 110B may have a male connector 210B configured with a pin 230. In various embodiments, the second arm component 110B may be configured to engage with an adjacent back support component 120C with the opposite connector type (e.g., a female connector 210A configured with a receiving hole 220). As shown in FIG. 9D, the adjacent back support component 120C may also have the opposite connector type (e.g., a male connector 210B) on the opposite side of the back support component configured to engage either another back support component or the first arm component 110A. FIG. 10 illustrates an example back support attachment mechanism configured with both a female connector 210A and a male connector 210B. In various embodiments, other attachment mechanisms may be used in place of the male and female connectors discussed herein.

Method of Assembly

FIG. 7 illustrates a method of assembling a modular seat of an example embodiment. Referring now to Block 700 of FIG. 7, the method may include providing a first seating component 120A having one or more seating component attachment apertures. As shown in FIG. 3A, the first seating component 120A may include a first seating component attachment aperture 300A and a second seating component attachment aperture 300B. In some embodiments, the seating component attachment apertures 300A, 300B may be configured to receive an arm component shelf support 310 or an attachment member 115A.

Referring now to Block 710 of FIG. 7, the method includes attaching a first arm component 110A to the first seating component 100A by attaching an arm component shelf support 310 to one of the seating component attachment apertures 300A. In various embodiments, as discussed herein, the shelf support 310 of the first arm component 110A may be configured to be received by a seating component attachment aperture, such as seating component attachment aperture 300A. The first arm component 110A may be attached to the first seating component 100A via one or more base attachment mechanisms 325A, 325B at one or more attachment points 330. In various embodiments, the base attachment mechanisms 325A, 325B may be t-handle screws or the like.

Referring now to Block 720, in an instance in which the modular seat has two or more seats (e.g., a love seat or sofa), the method may include attaching an attachment member 115A to one of the seating component attachment apertures (e.g., 300B) not attached to the arm shelf support 310 of the first arm component 110A. In various embodiments, the attachment member 115A may be configured to be received by a seating component attachment aperture, such as seating component attachment aperture 300B. Additionally, the attachment member 115A may be configured to extend beyond the seating component 100A, such that the attachment member 115 may be attached to a second seating component 100B.

Referring now to Block 730, the method may include attaching one or more additional seating components 100B, 100C having one or more seating component attachment apertures via one or more attachment members 115A, 115B. In various embodiments, the number of attachment member 115A, 115B used in a modular seat is based on the number of seating components (e.g. the number of attachment members may be one less than the number of seating components). In various embodiments, the attachment members 115A, 115B may be attached to the seating components via base attachment mechanisms 325E, 325F. In various embodiments, the base attachment mechanisms 325E, 325F may be t-handle screws or the like.

Referring now to Block 740, the method may include attaching a second arm component 110B to one of the seating components 100A-C via one of the seating component attachment apertures not attached to the first arm component shelf support 110A or an attachment member 115A, 115B. In various embodiments, the second arm component 110B may be attached to the seating component opposite the first seating component 100A. For example, as shown in FIGS. 1A-1B, the second arm component may be attached to the third seating component 100C opposite the first seating component 100A. In various embodiments, the second arm component 110B may be attached to the seating components via base attachment mechanisms 325. In various embodiments, the base attachment mechanisms 325 may be t-handle screws or the like.

Referring now to Block 750, the method may also include attaching one or more back support components 120A-C to one or more of the seating components 100A-C. In various embodiments, the seating components 100A-C may define a seating component shelf support 315 configured to be received by the back support component attachment aperture 320 via one or more base attachment mechanisms 325C, 325D. In various embodiments, the base attachment mechanisms 325C, 325D may be t-handle screws or the like. In various embodiments, there may be one back support component 120A-C for each seating component 100A-C (e.g., for a modular seat with one seating component, there may be one back support component; for a modular seat with two seating components, there may be two back support components; etc.)

In an example embodiment, a modular seat may be assembled by a user. In order to assemble a chair, a seating component (e.g., 100A) may be provided along with one back support (e.g., 120A) and two arm components (e.g., 110A, 110B). The arm component shelf support 310 of each arm component 110 may be attached to one of the seating component attachment apertures (e.g., 300A or 300B shown in FIG. 3A). The arm components 110A, 110B may be attached via base attachment mechanisms 325 (e.g., the t-handle screw shown in FIG. 6). The seating component shelf support 315 may be attached to the back support component attachment aperture 320 via attachment mechanisms 325 (e.g., a t-handle screw). The legs 200 may then be attached (e.g., screwed into place) to the bottom of the arm components 110 at the leg attachment points 335 (e.g., generally at each corner of the chair).

In an instance in which a larger modular chair is being assembled, multiple seating components 100 may be provided (e.g., two seating components 100A, 100B for a love seat, three or more for a sofa 100A-C, and/or the like). In such an example, the seating components 100A-C may be identical to one another. For example, each seating component 100A-C may have seating component attachment apertures 300A, 300B on each side of the bottom of the seating component 100A-C. In some embodiments, each seating component 100 may have a seating component shelf support 315 on one side of the bottom of the seating component 100A-C configured to engage a back support component 120A-C. During assembly, a first seating component 100A may operate as an end seating component, such that one of the arm components 110A may be attached thereto. For an end seating component, the assembly is the same as discussed for a chair above, except that an attachment member 115A is attached to one of the seating component attachment apertures 300A or 300B in place of one of the arm components 110B. Additionally, a second seating component 100B is then attached to the attachment member 115A that is attached to the first seating component 100A. In some instances, the adjacent back support components 120A, 120B may be coupled together via the back support attachment mechanism 210. For example, a first back support component 120A may have a pin 230 that engages with a receiving hole 220 of the second back support component 120B, such that additional stability is provided. In an example in which a two-seat (e.g., a love seat) piece of furniture is being assembled, a second arm component 110B may be attached to the seating component attachment aperture 300A or 300B on the second seating component 100B opposite the attachment member 115A. As discussed herein, the first arm component 110A and the second arm component 110B may be distinct from one another, such that one of the arm components defines a left arm component and the other arm component defines a right arm component. For example, the first arm component may be equipped with a female connector (e.g., receiving hole 220) for the back support attachment mechanism 210A, while the second arm component may be equipped with a male connector (e.g., pin 230) for the back support attachment mechanism 210B. In an example with three or more seating components 100A-C, a second attachment member 115B may be placed opposite the first attachment member 115A, such that an additional seating component 100C may be coupled thereto. The operations of adding additional seating components 100 is the same as utilizing the first and second seating components 100A, 100B. Legs 200 may be screwed into the attachment members 115A, 115B via leg attachment points 335 to provide additional stability to the modular seat. As such, various embodiments allow for a streamlined assembly of a modular seat without complex fastening devices or the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A modular seat comprising:

a first seating component having one or more seating component attachment apertures; and a first arm component having a first arm component shelf support configured to be received by one of the seating component attachment apertures, wherein the first arm component is configured to engage one or more legs, wherein the first arm component shelf support is configured to support at least a portion of a weight of the first seating component, and wherein the one or more seating component attachment apertures are disposed along the bottom surface of the first seating component.

2. The modular seat of claim 1, further comprising an attachment member, wherein the attachment member is configured to be received by one of the seating component attachment apertures, and wherein when the attachment member is received by one of the seating component attachment apertures, a portion of the attachment member extends beyond the seating component attachment aperture.

3. The modular seat of claim 2, further comprising a second seating component having one or more seating component attachment apertures, wherein the portion of the attachment member extending beyond the seating component attachment aperture of the first seating component is configured to be received by one of the seating component attachment apertures of the second seating component.

4. The modular seat of claim 1, wherein the first seating component further comprises a seating component shelf support configured to be received by a back support attachment aperture.

5. The modular seat of claim 1, further comprising a back support component having a back support attachment aperture to receive a seating component shelf support of the first seating component.

6. The modular seat of claim 5, wherein the first seating component is attached to the first arm component via a base attachment mechanism and the back support component further comprises an adjacent back support attachment mechanism.

7. The modular seat of claim 2, wherein at least one leg is attached to the attachment member.

8. The modular seat of claim 1, further comprising a second arm component comprising a second arm component shelf support, wherein the second arm component shelf support is configured to be received by one of the seating component attachment apertures that is not attached to the first arm component shelf support.

9. The modular seat of claim 1, further comprising one or more seat extensions, wherein the seat extension comprises an additional seating component and an additional back support, and wherein the additional seating component is attached to one of the other seating components via an attachment member.

10. A method of assembling a modular seat, the method comprising:

providing a first seating component having one or more seating component attachment apertures;

attaching a first arm component to the first seating component by attaching a first arm component shelf support to one of the seating component attachment apertures;

attaching an attachment member to one of the seating component attachment apertures not attached to the first arm component shelf support such that a portion of the attachment member extends beyond the seating component attachment aperture; and attaching at least one leg to the first arm component, wherein the first arm component shelf support is configured to support a portion of a weight of the first seating component.

11. The method of claim 10, further comprising attaching a second seating component having one or more seating component attachment apertures to the attachment member.

12. The method of claim 10, further comprising attaching the first seating component to a back support component by attaching a seating component shelf support to a back support component attachment aperture.

13. The method of claim 12, wherein the first seating component is attached to the first arm component via a base attachment mechanism and the back support component further comprises a back support connection mechanism.

14. The method of claim 11, further comprising attaching at least one leg to the attachment member.

15. The method of claim 10, wherein the one or more seating component attachment apertures are disposed along the bottom surface of the first seating component.

16. The method of claim 13, wherein the base attachment mechanism comprises a t-handle screw.

17. The method of claim 10, further comprising attaching a second arm component comprising a second arm component shelf support, wherein the second arm component shelf support is configured to be received by one of the seating component attachment apertures that is not attached to the first arm component shelf support.

18. The method of claim 10, further comprising attaching one or more seat extensions, wherein the seat extension comprises an additional seating component and an additional back support, and wherein the additional seating component is attached to one of the other seating components via an attachment member.

19. A modular seat comprising:

a first seating component having one or more seating component attachment apertures;

a first arm component having a first arm component shelf support configured to be received by one of the seating component attachment apertures, wherein the first arm component is configured to engage one or more legs, and wherein the first arm component shelf support is configured to support at least a portion of a weight of the first seating component;

an attachment member, wherein the attachment member is configured to be received by one of the seating component attachment apertures, and wherein when the attachment member is received by one of the seating component attachment apertures, a portion of the attachment member extends beyond the seating component attachment aperture; and a second seating component having one or more seating component attachment apertures, wherein the portion of the attachment member extending beyond the seating component attachment aperture of the first seating component is configured to be received by one of the seating component attachment apertures of the second seating component.

20. The modular seat of claim 19, further comprising a second arm component comprising a second arm component shelf support, wherein the second arm component shelf support is configured to be received by one of the seating component attachment apertures of the second seating component that is not attached to the attachment member.

* * * * *